US008125403B2

(12) United States Patent
Hager

(10) Patent No.: US 8,125,403 B2
(45) Date of Patent: Feb. 28, 2012

(54) TUBULAR TELECOM TOWER

(75) Inventor: Peter Hager, Djursholm (SE)

(73) Assignee: Telefonaktiebolaget L M Ericsson (publ) (SE)

( * ) Notice: Subject to any disclaimer, the term of this patent is extended or adjusted under 35 U.S.C. 154(b) by 781 days.

(21) Appl. No.: 12/293,689

(22) PCT Filed: Dec. 15, 2006

(86) PCT No.: PCT/SE2006/050584

§ 371 (c)(1),
(2), (4) Date: Sep. 19, 2008

(87) PCT Pub. No.: WO2007/108731

PCT Pub. Date: Sep. 27, 2007

(65) Prior Publication Data

US 2010/0315309 A1 Dec. 16, 2010

Related U.S. Application Data

(60) Provisional application No. 60/783,378, filed on Mar. 20, 2006.

(51) Int. Cl.
*H01Q 1/12* (2006.01)

(52) U.S. Cl. ..... 343/890; 343/874; 52/40; 52/111

(58) Field of Classification Search ..... 343/874, 343/878, 890, 891, 892; 52/40, 111
See application file for complete search history.

(56) References Cited

U.S. PATENT DOCUMENTS

| | | | | |
|---|---|---|---|---|
| 4,377,812 | A * | 3/1983 | Gobel et al. | 343/872 |
| 5,904,004 | A * | 5/1999 | Hill | 52/40 |
| 5,969,693 | A * | 10/1999 | Legg | 343/890 |
| 5,995,063 | A | 11/1999 | Somoza et al. | |
| 6,131,349 | A | 10/2000 | Hill | |
| 6,173,537 | B1 * | 1/2001 | Davidsson et al. | 52/40 |
| 6,335,709 | B1 | 1/2002 | Cummings | |
| 2005/0078049 | A1 * | 4/2005 | Trankina | 343/890 |

FOREIGN PATENT DOCUMENTS

| | | | |
|---|---|---|---|
| DE | 94 07 220.5 | U1 | 7/1994 |
| DE | 20 2005 010 398 | U1 | 9/2005 |
| DE | 20 2005 010 140 | U1 | 10/2005 |
| EP | 1 198 024 | A1 | 4/2002 |
| WO | WO 98/58420 | | 12/1998 |

OTHER PUBLICATIONS

Supplementary European Search Report corresponding to EP 06 82 4642, mailed Feb. 11, 2009, 7 pages.

International Search Report and Written Opinion dated Feb. 7, 2007 (9 pages).

* cited by examiner

*Primary Examiner* — Tho G Phan

(74) *Attorney, Agent, or Firm* — Myers Bigel Sibley & Sajovec, P.A.

(57) ABSTRACT

The present invention aims to provide a hollow antenna tower structure for use in a wireless communications network. The tower comprises tubular tower sections made of concrete, and having a generally hollowed cross section. A movable base station unit, having at least one antenna and at least one micro wave link, is being disposed inside the tubular tower. The whole base station unit is movable up and down inside the tower by the aid of an elevator system. The tower further comprises at least one entrance into the tower and a climbing facility and/or a second elevator system, inside the tower, giving access to the base station unit.

28 Claims, 6 Drawing Sheets

Basic example of an antenna tower structure top

TUBULAR TELECOM TOWER

TECHNICAL FIELD

The present invention generally relates to telecom towers, and in particular, to a tubular antenna tower structure for use in a wireless communications system.

BACKGROUND

Prevailing technology for telecom towers/masts, whether self supported or guyed, are lattice steel constructions. These masts are often galvanized using hot dip galvanization, where the steel structure is coated with a layer of Zinc. Steel towers are usually manufactured for a design life between 30-50 years. Coated structures are sensible to mechanical wear, and lattice steel towers are no exception. Towers get surface damages during transportation and installation, and such damages need to be mended when the tower is installed. Since hot dip is not an option when the tower is installed, painting/spraying with cold galvanization is a method used. Damages to a protective Zink layer can not be avoided during transportation and installation and corrosion will start at damaged areas. Corrosion is what sets design life for all steel structures, and regardless of Zink cotes, certain maintenance is required to stop corrosion during a construction life time.

Many new types of masts are under development. Patent documents WO02/41444 A1, US2003/0142034 A1 and U.S. Pat. No. 5,995,063 A, are some of the documents that describe a hollow/tubular antenna mast having an inside and an outside part.

Patent document, WO02/41444 A1, describes a communications mast assembly comprising a mast extending from submergible equipment housing. The housing may house air-conditioning equipment, which is located in the access room of the housing. The arrangement is being further such that the mast provides ventilation ducts in the form of inlet and outlet passages for atmospheric air circulation.

Patent document, US2003/0142034 A1, describes a telecommunications mast installation comprising a hollow mast supporting a telecommunications antenna and a foundation structure supporting the mast. According to the invention the foundation structure is in the form of an enclosed chamber situated at least partially and preferably fully, underground. The chamber defines an internal space which is accessible to personnel and which accommodates electronic equipment associated with operation of the antenna.

Patent document, U.S. Pat. No. 5,995,063 A, describes an antenna structure comprising a hollow antenna mast having an inside and an outside, a specially designed movable module disposed inside said hollow antenna mast and lifting means. The movable module has at least one antenna, at least one RF module and at least one RF transmission means connected to the at least one antenna and the at least one RF module. The lifting means permit the raising and lowering of the movable module inside the hollow antenna mast between a lower position and an upper position.

Other types of telecom towers/masts exist and are referred to as Monopoles, which basically are steel, aluminium or concrete poles on which a telecommunication system is attached on an external surface part.

Some of the problems with existing solutions and constructions are that they, in a general publics view, are perceived as an unwelcome part of a landscape view. Existing tower structures are in many cases expensive to produce, expensive and difficult to perform service on and they require separate equipment facilities such as shelters or outdoor protected equipment. In some solutions the telecom equipment is attached to the tower and is consequently exposed to weather variations.

SUMMARY

Hollow telecom towers made from concrete represent a new sort of thinking. None of the mentioned prior art documents describe concrete hollow structures were an inside of a tower is utilized as shelter, air pump, temperature equalizer, and elevator shaft for a whole antenna radio base station (RBS) all in the same construction.

An embodiment of the present invention is therefore to introduce a new antenna tower structure for use in a wireless communications network, wherein the tower is less expensive to produce and perform service on without interrupting radio transmission as long as possible.

It is an object of the present invention to introduce a new antenna tower structure having a considerably longer life cycle, better characteristics and with a more environment friendly manufacturing process.

It is another object of the present invention to introduce a new antenna tower structure where all telecom equipment is fully integrating inside an exterior surface. By such a construction geometry, and the fact that telecom equipment is totally enclosed within boundaries of construction, the antenna tower structure can thus function in a similar way as a Faradays cage with regard to protecting the equipment from lightning strikes and electro magnetic pulses (EMPs).

It is yet another object of the present invention to provide a hollow antenna tower structure for use in a wireless communications network. The tower comprises tubular tower sections made of concrete, and having a hollowed cross section. The tower further comprises an arrangement for moving a whole antenna radio base station along the elongation of the inside part of the antenna tower structure. The tower further comprises at least one entrance into the tower giving access for service of the antenna radio base station.

It is yet another object of the present invention to provide a method of manufacturing one or more sections of a radio base station antenna tower structure for use in a wireless communications network. The method is characterised by a first step of casting the antenna tower structure sections into tubular tower sections having a hollowed cross section. A second step is to arrange at least one antenna tower structure section with an entrance into the antenna tower structure. A third step is to arrange the antenna tower structure sections for a mechanism for moving at least a whole antenna radio base station inside the antenna tower structure. A fourth step is to arrange the antenna tower structure sections for inclusion of a service access system.

Yet another object of the present invention is to provide a wireless communications system comprising one or more antenna tower structures, wherein each structure is equipped with at least one antenna Radio Base Station serving as an access point for user equipments. The wireless communications system is characterised by the antenna tower structures being cast and divided into tubular tower sections having a hollowed cross section. The sections further comprise an arrangement for moving a whole antenna radio base station along the elongation of the antenna tower structure. The antenna radio base station is being disposed inside the tubular tower. Additionally, each antenna tower structure has at least one entrance into the antenna tower structure giving access for service of the antenna Radio Base station.

DETAILED DESCRIPTION

Figure 1:
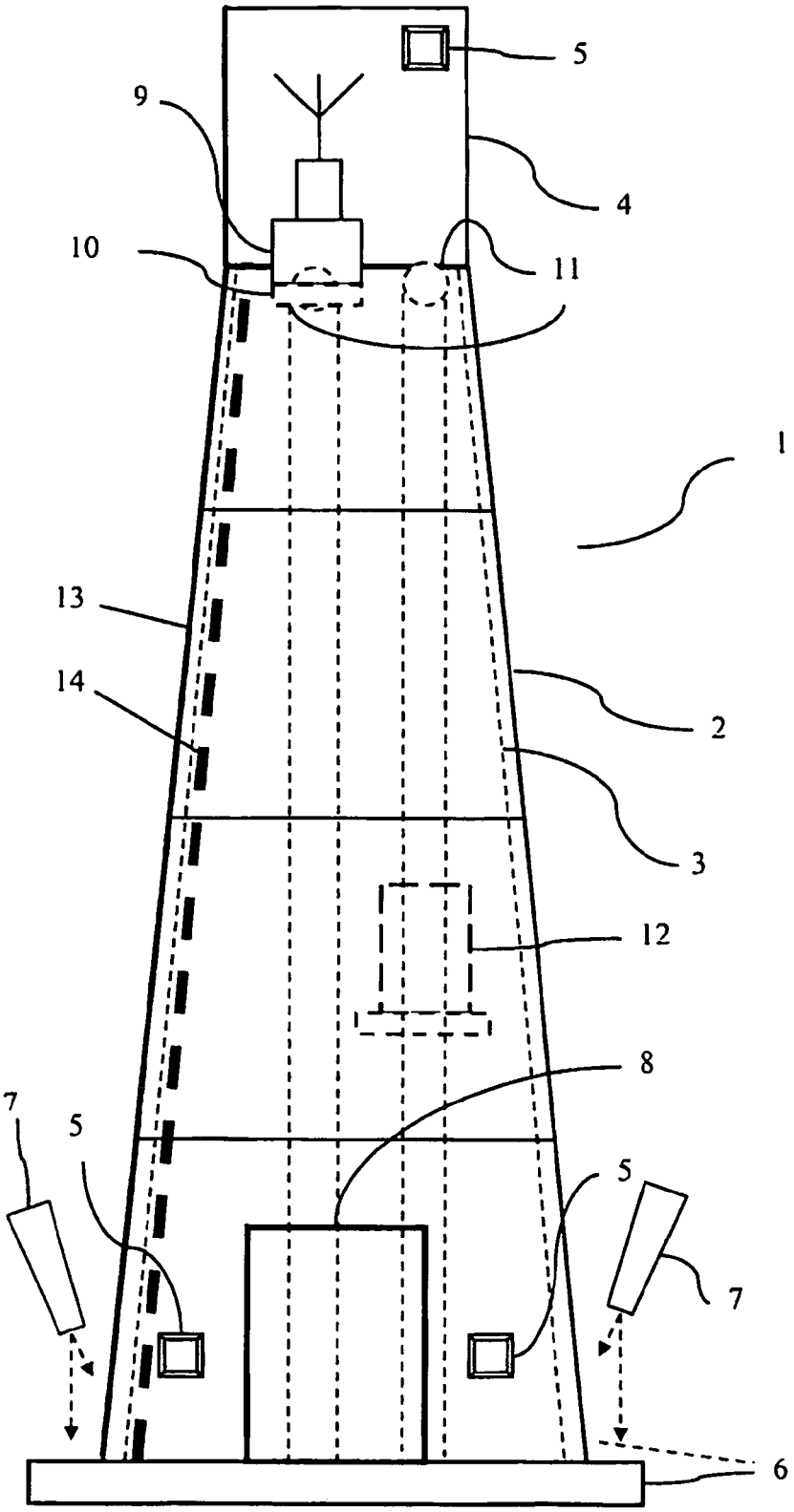
FIG. 1 illustrates an antenna tower structure according to an embodiment of the present invention.

Benefits of creating a tower, as described by the present invention, in concrete are uncountable. Problems with corrosion, cables and feeders out in the open, radio transmission interruption during service or reparation etc., are to be avoided by the present invention.

US patent document, U.S. Pat. No. 5,995,063 A, mentions that parts of RBS equipment could be placed at a top section of an antenna tower, in order not to use long feeders with substantial damping and power losses as a consequence. This technique is related to as "main remote unit" and is used mostly for small site RBSs. The "main remote unit" concept relates to moving parts of a RBS to a location nearer the top of a tower or mast. This way some feeder loss is avoided, among other benefits. However, a principle of placing the whole RBS in a top section of an antenna tower and giving availability for at place maintenance, no requirement for outdoor equipment and structural strength benefits in combination, is not even closely to the above discussion. These three needs in combination have made it impossible, in prior art systems, to place Macro equipment at the top section of the antenna tower structure. On place service/maintenance is becoming a big need for operators when radio down time costs is to be minimized.

According to an embodiment of the present invention an antenna tower structure (ATS) is manufactured from reinforced concrete. A type of concrete/mix is chosen in such a way that it is possible to guarantee a design life of >100 years without maintenance. The concrete antenna tower structure is not sensible to scratches and surface damages in a same way as coated steel structure. Preferably, the tower will not be painted, colors come from pigmented concrete.

These are some benefits discovered when manufacturing and developing ATSs made of concrete:

1. Thermally Slow

An RBS has requirements for surrounding temperature usually within approximately +5 degrees to +45 degrees Celsius. This will cause a problem in hotter climates with very high temperatures daytime. However, temperatures nighttime, even in hotter climates, goes down many degrees. A conventional, thermally fast, construction such as telecom shelters is using active cooling such as air conditioners to cool equipment. Active cooling consumes a lot of power and is therefore the no. 1 operational expenditure (OPEX), the ongoing costs for running a product, for an operator of a network. Concrete is a thermally slow material. The ATS intends to utilize this in leveraging of temperature during 24 h in hot climates. At night time the ATS will cool down as a consequence of lower outdoor temperature. Lower outdoor temperature, "Stack effect", will not alone be able to cool the ATS and mechanical forced/controlled ventilation may be required. Daytime when temperature again raises the mass in a cooled ATS will manage to cut a peak temperature and is therefore capable of maintaining a cooler indoor climate.

2. Local Production

Steel lattice towers and other kinds of towers require factory manufacturing. Precise cutting of steel, welding environment and hot dip galvanization all require factory indoor facilities. Steel lattice towers are often manufactured remotely from a site establishment and are often exported between countries and continents.

According to an embodiment of the present invention the ATS is cast in concrete. Concrete is a mix of cement, aggregates and water. As long as ingredients are available it can be mixed any where. The ATS will be made of sections and every section will require a mould. The mould is made of steel and sets the exact measurements for the cast elements. The moulds can be reused thousands of times. Since the manufacturing process is quite simple, providing the mould is adequately made, the ATS can be produced in temporary established field factories. Thereby cutting a major part of the costs and adding considerably simplicity to the manufacturing process, as well as being more environment friendly at the same time.

3. Cost Reduction

Cost criteria are already discussed above. The ATS will be considerably heavier than a steel lattice tower but the cost per ton will be considerably lower and in total material cost for the ATS will be approximately half of an equivalent lattice tower. With regards to production, casting of elements is a quite simple process and production costs for casting of elements are lower than for production of steel lattice towers.

4. Rigidity/Stiffness

From a construction point of view, concrete offers benefits compared with steel structures like for example sway damping and wear out.

5. Weight/Foundation

Forces that act on a tower are related to wind. Design parameters are wind area, wind speed, surface factors, return period, terrain category etc. In order not to turn over when exposed to wind, towers use a foundation. A prevailing foundation technique for steel lattice towers is a raft and chimney construction made of on site cast concrete. Example concrete raft volume is approximately 35 cubic meters (m3), of course dependent on height of tower and load cases etc, but as a rule of thumb. Translated into weight it is equivalent to approximately 85 tons. A preferred ATS has a typical calculated weight of approximately 30 tons (13 cubic meters concrete). The ATS has a majority of its weight close to ground, which makes it a very stable construction with regards to overturning. Total weight above ground of the ATS means that the need for a foundation decreases, or is made differently. The foundation for the ATS will be made by expandable steel piles sometimes in combination with soil anchors. This is a quick and less costly method than on site cast foundation.

6. Free Shaping

Concrete can be shaped into any form and/or color. Exact replicas can be made in thousands from the same mould. This is an intention with the ATS, to create different and unique shapes. Lattice steel does not have this freedom.

7. Environment

Production of steel is energy consuming. According to statistics of Embodied Energy Coefficients developed at Victoria University, Wellington NZ, galvanized virgin steel has a coefficient of 34.8 MJ/Kg. Pre-cast concrete typically require 2.0 MJ/Kg. The ATS body consists of reinforced pre-cast concrete. According to index steel rebar has a coefficient of 8.9 MJ/Kg which is one component in the tower tube. Calculated for a preferred tower tube is ~200 kg reinforcement per cubic meter of concrete. This implies 1780 MJ for the rebar in every cubic meter of concrete. Example tower tube consumes approximately 13 cubic meters concrete. Concrete has a specific weight of approximately 2500 kilo gram/cubic meter. This implies 2×2500 MJ per cubic meter of concrete. In total a preferred example of a tower will have a coefficient of 13×(1780+5000) MJ=88,140 MJ. A steel lattice tower (40 meters) has an approximate weight of 9.000 kg. 9000×34.8 MJ=313,200 MJ.

Thus, the ATS of the example consumes about 25% of the energy required to produce an equivalent lattice tower.

Summing up, the ATS of the present invention is considered to have many benefits compared to prior art towers/masts created from other materials than concrete.

FIG. 1 shows an antenna tower structure according to an embodiment of the present invention. The tower structure 1, including all its sections, is a thin wall construction, leaving the entire tower structure to be hollow from its lowest part to its top. The construction, including its lower sections, may be insulated on its inside either during manufacturing or after assembly. The sections are attached to each other by bolts or adhesive or a combination of both. Other techniques to attach the sections, such as but not limited to, welding, screwing, rivet together, locking mechanism, wedging are also to be used. The tower sections have an external 2 and an internal 3 wall part. A top section 4 of the tower structure 1 is made of a material protecting the inside of the antenna tower structure 1, from for example rain and snow, and at same time not significantly attenuating passage of radio signals. Such material is for example fibre composites. According to a preferred embodiment the ATS 1 has a plurality of controllable ventilation openings 5 at lower parts and higher parts permitting controllable air circulation causing a cooling mechanism inside the antenna tower structure 1. A lowest ground section 6 (base section, bottom section) is attached to the ground by expandable piles 7 or as a traditional raft and chimney. An entrance 8 permits access to the inside of the tower and thereby access to a climbing facility 14, an antenna radio base station (RBS) elevator 10 and to the antenna RBS 9. The elevator 10 is controlled by an elevator system 11 permitting lowering and raising of the whole antenna RBS 9. Alternatively a second elevator system is used for a personnel elevator 12. Preferably, the personnel elevator 12 is constructed as a cage protecting a person inside the elevator 12 from sharp edges in the inside part of the ATS 1. A purpose of the climbing facility 14 and the second elevator system 11 is to give access to the antenna RBS 9 at any position of the antenna RBS 9. When the tower structure 1 is manufactured metal mesh, rebar, is included in the mould giving every section of the tower 1 an integrated metal mesh structure, which after assembly and connection will give the inside of the entire tower structure a Faraday shield similar functionality, i.e. Lightning Protection Shield (LPS) 13. Example materials in the tower is for the purpose of this invention, steel fibrous cement based composites i.e. concrete blended metal mesh and/or rebar. Other materials are also to be considered able, are such as, but not limited to, metal, plastics, cement based materials, wood, glass, carbon fibre and composites of the same.

In a preferred alternative, the ATS 1 is constructed in one piece wherein the hollow structure, from ground level to tower top, allows telecom equipment to be hoisted up and down inside the structure in an indoor environment.

According to an embodiment of the invention, the preferred conical shape of the ATS will force hot air to rise from the base section 6. Since the tower is so tall there will be an over pressure at the top section 4 of the conical antenna tower structure 1 and an under pressure at the base section 6. This will make the construction into a huge "air pump", which will function as its own free cooling system simply by using the laws of physics.

Many benefits are achieved by being able to have a construction permitting placing a whole antenna Radio Base Station in top of an antenna tower structure, as in the present invention. Such benefits are for example:

- installation simplicity;
- optimal radio transmission usage. Short feeders mean that a need for tower mounted amplifiers are minimized;
- possibility to manage all possible radio standards (RBS, micro wave links, radar systems etc);
- requiring only standard radio equipment for indoor environment;
- requiring only standard antenna equipment for indoor environment;
- possibility to manage a combination of different radio standards with almost no loss at all, for example by implementing multi antenna solutions;
- possibility to manage multi antenna solutions;
- possibility for multi sector solutions.

Figure 2:
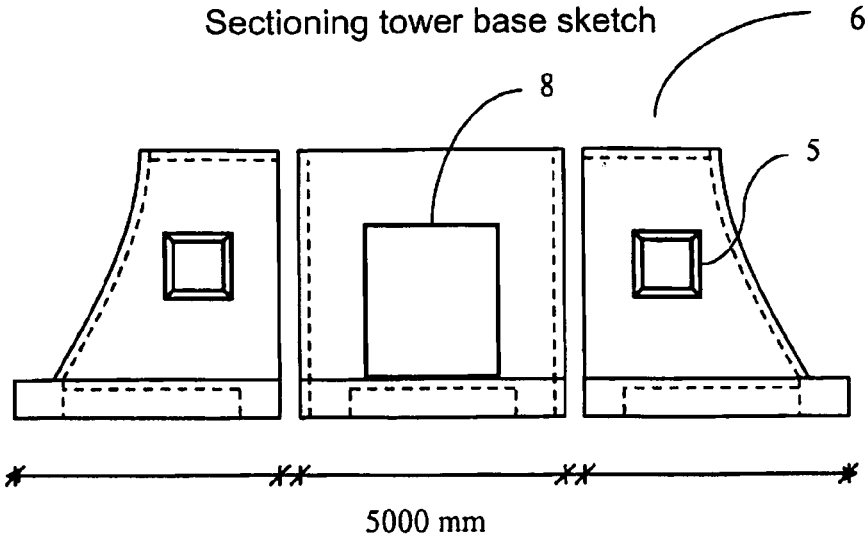
FIG. 2 illustrates a tower structure base section sketch according to an embodiment of the present invention.

FIG. 2 describes a non exclusive example of a base section of the ATS 1 with geometry suitable for pile 7 foundations. According to the figure, the base section 6 is typically around 5000 mm and has a preferred shape of a circle. Typically 8-12 piles are used to attach the base section 6 to ground. Alternatively, the base section 6 is directly cast or mould into ground, by aid of a foundation part. The size and shape is not by any way limited to 5000 mm and circle shaped. Other examples of shapes are oval, square, rotating, triangular, rectangular, hexagonal, octagonal etc. The base section 6 includes one or more entrances 8, not shown in the figure, giving access to an inside part of the antenna tower structure 1. One or more controllable ventilation openings 5 at the base section part 6 permits controllable air intake for air circulation causing a cooling mechanism inside the antenna tower structure 1. The base section 6 (bottom section), which is hollow, is large enough to fit most equipment configurations in an indoor environment. The base section 6 is typically insulated, and that insulation is attached in mould and fitted while the sections are being cast. Electrical conduits are placed in the mould as well as other details. A benefit of having a hollow construction is avoidance of a separate shelter. Requirement for site fence is also avoided due to tower base natural scale protection and anti climbing geometry.

As an alternative, the base section 6 is built in separate parts which are to be put together on place.

Figure 3:
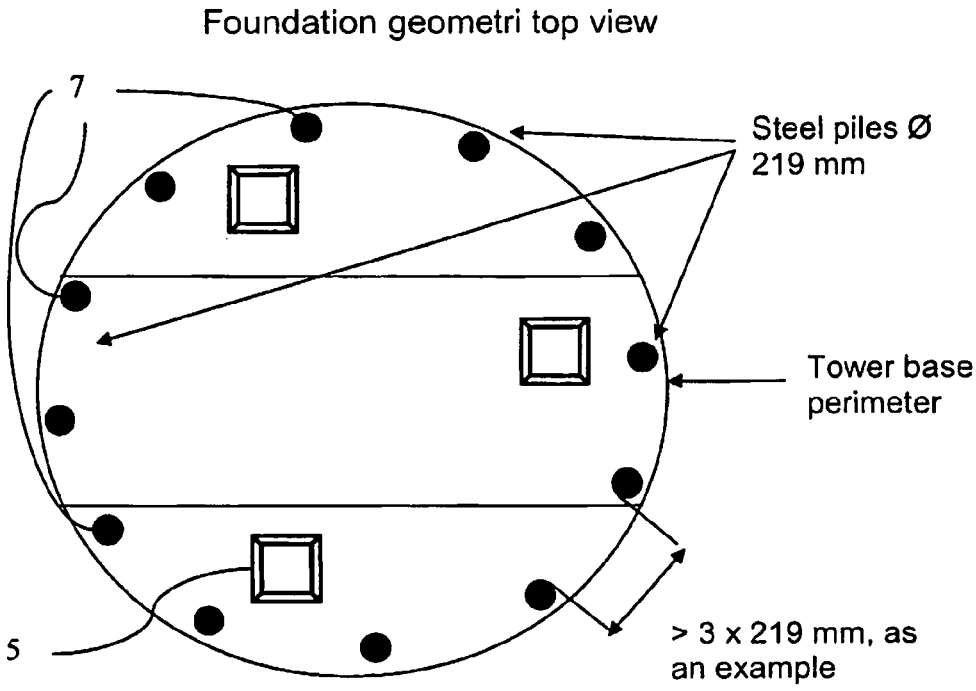
FIG. 3 is a Block diagram illustrating a foundation geometry top view according to an embodiment of the present invention.

FIG. 3 illustrates an example of a foundation geometry top view according to an embodiment of the present invention. According to the figure, twelve expandable piles 7 are used to attach the base section 6 into ground. One or more controllable ventilation openings 5 at a ground level permitting a controllable intake for air circulation inside the antenna tower structure 1 causing a cooling mechanism. Notice that FIG. 2 and FIG. 3 only give a description of examples of base sections used for explaining the present invention.

As described above, by totally enclosing all equipment into a construction having a "Faradays cage" similar functionality, both people and equipment will be protected from lightning strikes. According to an embodiment or the present invention it is possible to have a pre-constructed lightning protection system directly from factory or manufactured at place without the complexity and cost expensive procedures of prior art techniques.

Figure 4:
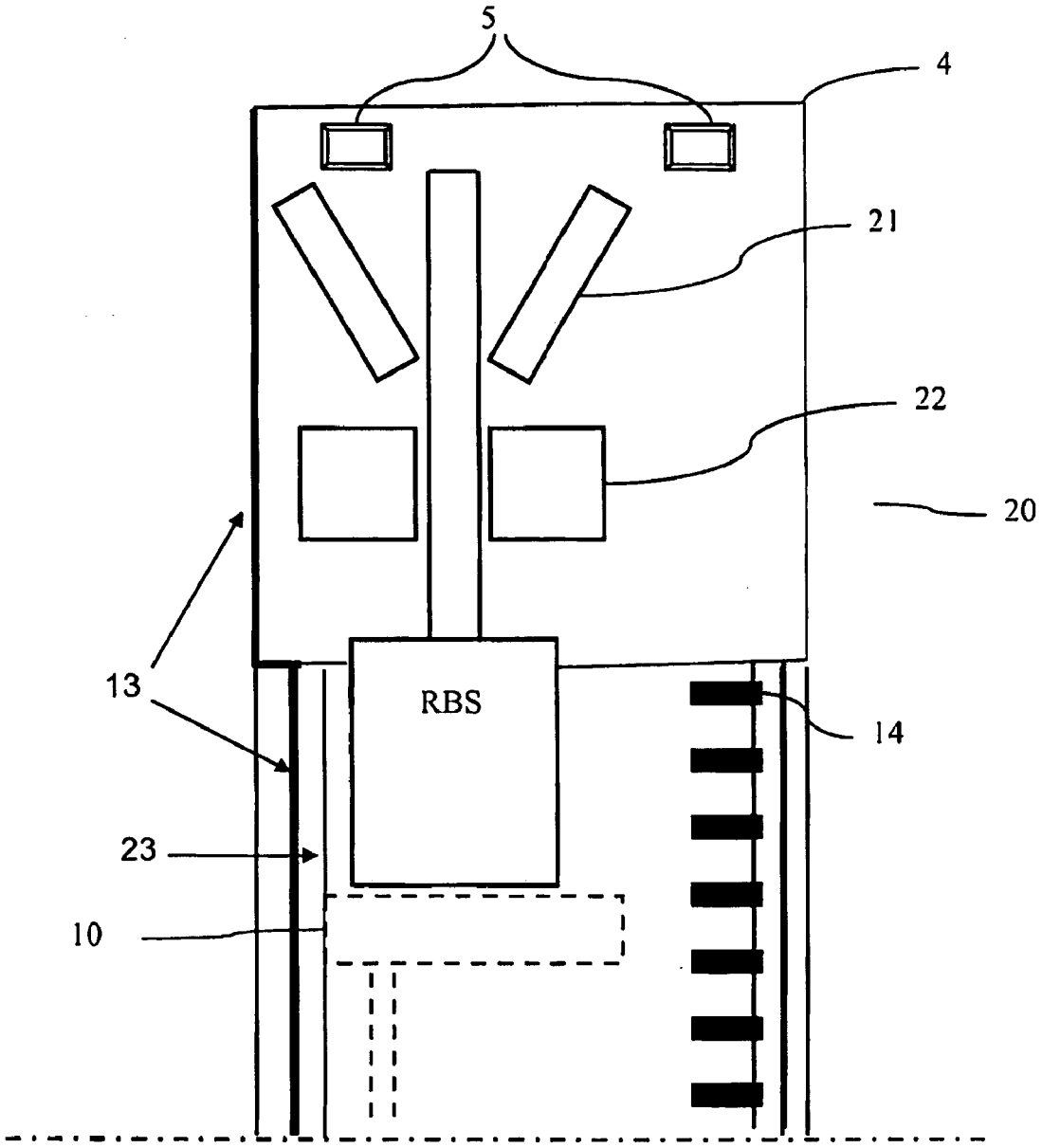
FIG. 4 illustrates a tower structure top section sketch according to an embodiment of the present invention.

FIG. 4 illustrates an example of a typical construction of a tower top section. The top section 4 is made of fibre glass or other material protecting the inside of the antenna tower structure, for example from rain and snow, and at the same time not significantly attenuating passage of radio signals. An antenna Radio Base Station (RBS) 9 is placed at the top section 4 during operation. The antenna RBS 9 is further, attached to at least one radio antenna 21 and at least one micro wave link. Metal mesh "rebar" and/or lightning protection system 13 are built in into each section of the tower antenna structure 1. Also the top section 4 is typically insulated, and that insulation is attached in mould and fitted while the sections are being cast. A climbing facility 14 gives access to the antenna RBS 9 at any location of the antenna RBS inside the ATS 1. This is important when to perform maintenance on the antenna RBS 9, without requiring radio down time, i.e. interruption in radio transmission. An elevator 10 is used to lower the antenna RBS 9 when/if absolutely needed. The elevator might be used by personnel as well when a minimum radio down time is considered as acceptable. Alternatively, a second elevator 12 is included in purpose to be used by personnel. One or more controllable ventilation openings 5 at the top section 4 permits controllable air intake for air circulation causing a cooling mechanism inside the antenna tower structure 1. Additional mechanical cooling means, i.e. air conditioning system, is most probably needed and typically placed in the base section 6 of the antenna tower structure 1.

Figure 5:
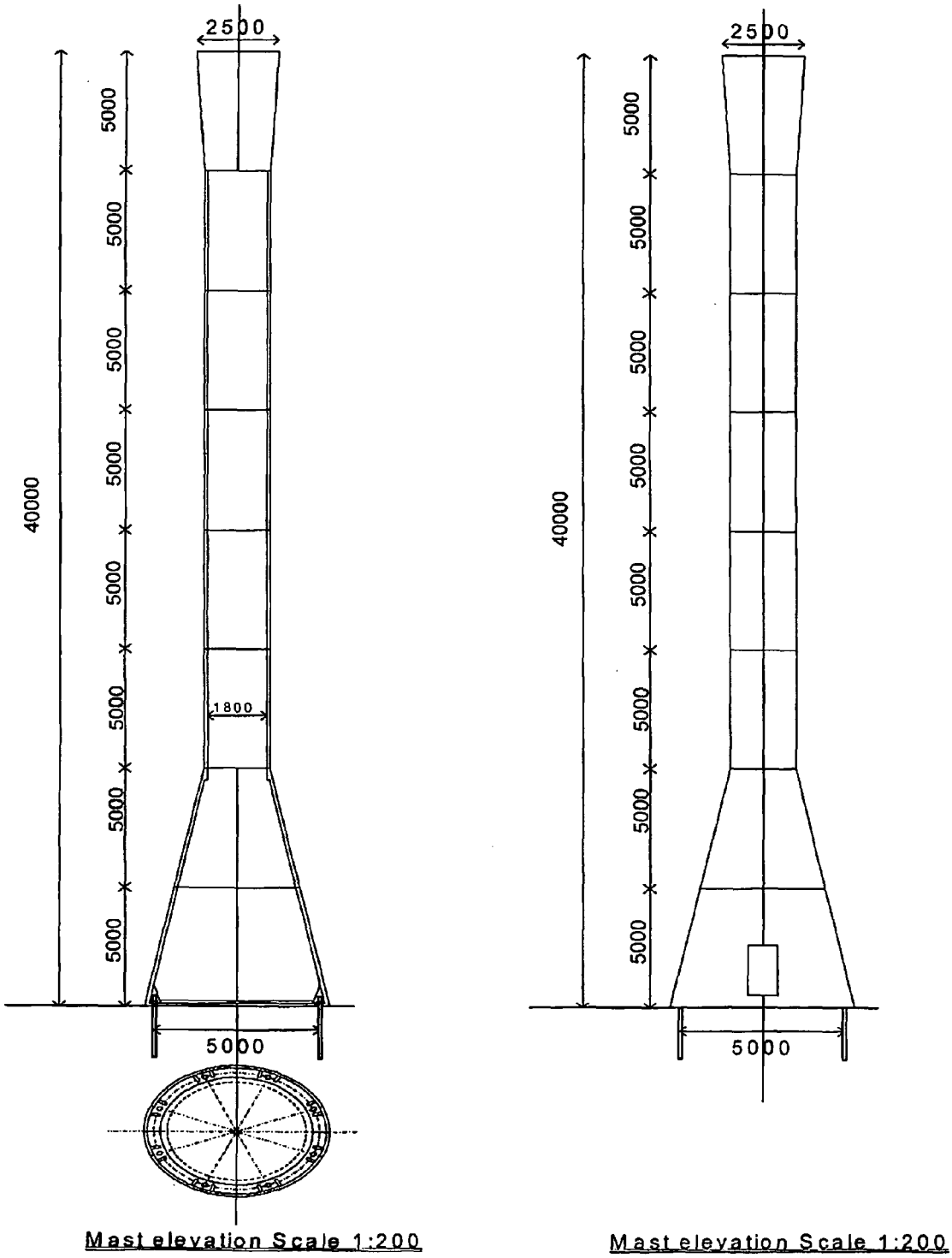
FIG. 5 illustrates some examples of antenna tower structures according to embodiments of the present invention.

Other examples of antenna tower structures are described in FIG. 5. A height of 40 000 mm is used in the examples, though the tower is not by any means limited to the sizes and shapes described in the figure. Other relevant antenna tower structure heights are all between 15 to 45 meters. Typical minimum base section 6 width size is 5 meters. Different conical shapes are suggested in FIG. 6, but other shapes are also under consideration. Sections are formed upon request and can be made to represent a signature as of an operator or to better fit into a landscape view. From a business perspective an important aspect of the present invention is to introduce a costumer specific antenna tower shape(s), working as a signature for an operator. As an alternative aspect, the antenna tower structure may form part of a support for an advertising board.

Figure 6:
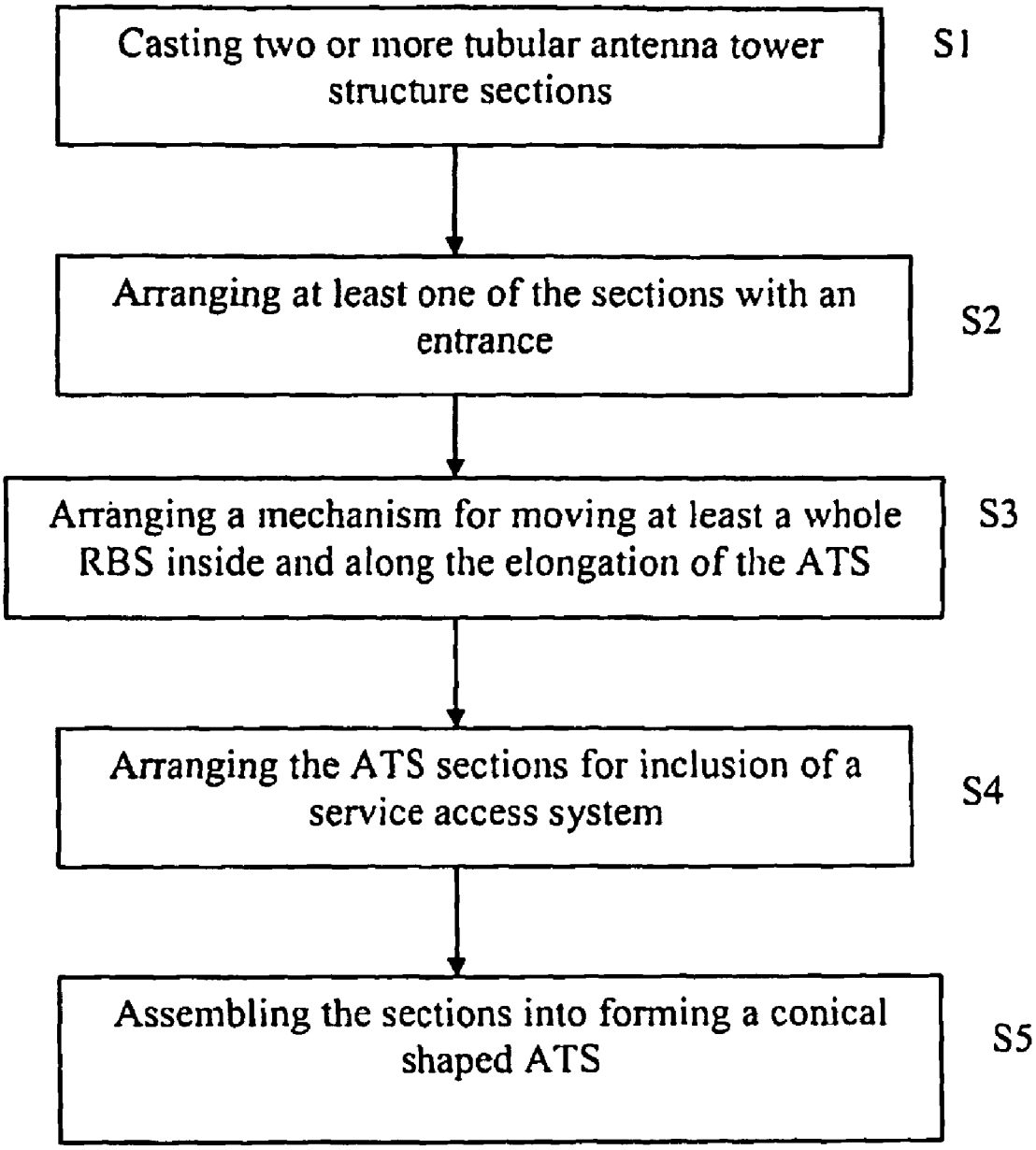
FIG. 6 is a flow chart illustrating a method according to an embodiment of the present invention.

FIG. 6 is a flow chart illustrating steps of a method according to an embodiment of the present invention. The flow charts relates to a method of manufacturing one or more sections of a radio base station antenna tower structure for use in a wireless communications network. A first step (S1) comprises casting the antenna tower structure sections into tubular tower sections having a hollowed cross section. A second step (S2) arranges at least one antenna tower structure section with entrance into the antenna tower structure. A third step (S3) arranges the antenna tower structure sections for a mechanism for moving at least a whole antenna radio base station inside the antenna tower structure. A fourth step (S4) arranges the antenna tower structure sections for inclusion of a service access system. Alternatively a following fifth step (S5) is introduced, the step of assembling sections into forming a conical shaped antenna tower structure.

According to a further embodiment of the invention the sections are cast in concrete, and arranged with a climbing facility and/or an elevator system that in combination with the at least one entrance gives access to the whole base station unit. Access is given at any position of the base station unit inside the completed antenna tower structure. Thus, the climbing facility and/or the elevator system permits the antenna radio base station, comprising at least one antenna and at least one micro wave link, to be rigidly connected both in operation and in service mode.

According to yet a further embodiment of the invention the antenna tower structure sections are made to fit together into forming a complete antenna tower having a conical shape. The sections are put together by such a procedure as but not limited to, welding, screwing, rivet together, locking mechanism or wedging. The sections are cast into any of the following shapes oval, square, rotating, triangular, rectangular, hexagonal, octagonal etc. An antenna tower structure top section is made in a form and of a material protecting the inside of the antenna tower structure, from for example rain and snow, and at the same time not significantly attenuating passage of radio signals.

Figure 7:
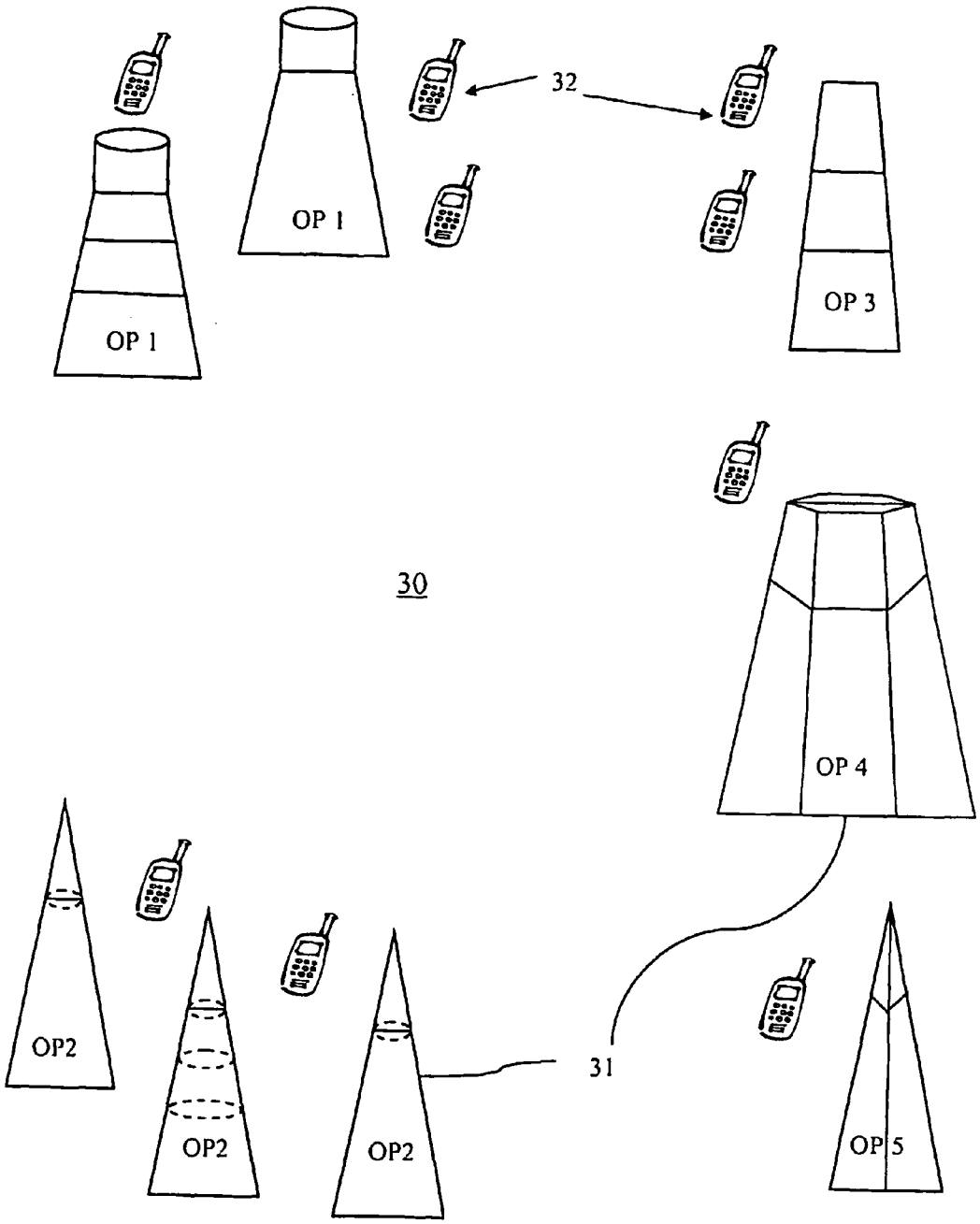
FIG. 7 is a block diagram illustrating a system according to an embodiment of the present invention.

FIG. 7 is a block diagram illustrating a system for wireless communication in accordance to an embodiment of the present invention. The wireless communications system 30 comprises one or more antenna tower structures 31 each equipped with at least one antenna Radio Base Station 9 serving as an access point for user equipments 32. The antenna tower structures of the system are being cast and divided into tubular tower sections having a hollowed cross section. The sections are equipped with an arrangement for moving a whole antenna radio base station along the elongation of the antenna tower structure, wherein the antenna radio base station is being disposed inside the tubular tower. Each antenna tower structure have at least one entrance into the antenna tower structure giving access for service of the antenna Radio Base station 9. The system 30, permits operator specific antenna tower structure designs (OP1, OP2, OP3, OP4, OP5 etc).

In a further embodiment, operator specific designs makes it more simple for service personnel to identify a specific antenna tower structure among other towers, wherein equipment in the tower is to be served, updated or reconfigured.

While the invention has been described with reference to specific exemplary embodiments, the description is in general only intended to illustrate the inventive concept and should not be taken as limiting the scope of the invention.

It will be understood by those skilled in the art that various modifications and changes may be made to the present invention without departure from the scope thereof, which is defined by the appended claims.

The invention claimed is:

1. An antenna tower structure for use in a wireless communications network comprising one or more Radio Base Stations (RBSs), the antenna tower structure comprising:

tubular tower sections having a hollowed cross section being made of concrete;

the antenna tower structure having an arrangement for moving a whole antenna radio base station along an elongation of the antenna tower structure through the tubular tower sections, the whole antenna radio base station being disposed inside the tubular tower; and at least one entrance into the antenna tower structure giving access for service of the whole antenna Radio Base station, wherein the at least one entrance gives access to the whole antenna radio base station at any position of the antenna radio base station inside the antenna tower structure, by aid of a moving arrangement, a climbing facility and/or an elevator system.

2. An antenna tower structure according to claim 1 where the whole antenna radio base station, comprising at least one antenna and at least one micro wave link, is rigidly connected both in operation and in service mode.

3. An antenna tower structure according to claim 1 where the tubular tower sections comprise ends that fit together into forming a conical shape.

4. An antenna tower structure according to claim 1 where the tower sections, having each a hollowed cross section, belongs to any of the following shapes oval, square, rotating, triangular, rectangular, hexagonal, or octagonal.

5. An antenna tower structure according to claim 1 where the tubular tower sections are to be constructed in such a way permitting on field manufacturing.

6. An antenna tower structure according to claim 1 where a top section of the antenna tower structure is made in a form and of a material protecting the inside of the antenna tower structure, from rain and snow, and at a same time not significantly attenuating passage of radio signals.

7. An antenna tower structure according to claim 1 where all equipment inside the antenna tower structure are enclosed in a Faradays cage that protects the equipment from lightning strikes.

8. An antenna tower structure according to claim 7 where the Faradays cage functionality is achieved by including metal mesh and/or conductors in every section of the antenna tower structure to provide an integrated electricity conducting structure, which after assembly functions as a Lightning Protection Shield, LPS, for the whole antenna radio base station.

9. An antenna tower structure according to claim 1 where a bottom section part of the antenna tower structure is constructed in such form permitting directly earth attachment, with expandable piles and/or anchors, without requiring additional construction work.

10. An antenna tower structure according to claim 1 where the antenna tower structure has a plurality of controllable ventilation openings at lower parts and higher parts of the antenna tower structure permitting controllable air circulation causing a cooling mechanism inside the antenna tower structure.

11. An antenna tower structure according to claim 1 where the antenna tower structure forms part of a support for an advertising board.

12. Antenna tower structure according to claim 1 where the antenna tower structure has a typical height between 15 to 45 meters.

13. A method of manufacturing one or more sections of a radio base station antenna tower structure for use in a wireless communications network, the method comprising:

casting the antenna tower structure sections into tubular tower sections having a hollowed cross section made of concrete;

arranging at least one antenna tower structure section with at least one entrance into the antenna tower structure;

arranging the antenna tower structure sections for a mechanism for moving at least a whole antenna radio base station inside the antenna tower structure along an elongation of the antenna tower structure through the tubular tower sections; and arranging the antenna tower structure sections for inclusion of a service access system, wherein the at least one entrance gives access to the whole antenna radio base station at any position of the antenna radio base station inside the antenna tower structure, by aid of the service access system including a moving arrangement, a climbing facility and/or an elevator system.

14. The method of claim 13, where one or more tubular tower sections are cast in concrete.

15. The method of claim 13, where the tubular tower sections are additionally arranged with a climbing facility and/or an elevator system that in combination with the at least one entrance gives access to the whole radio base station at any position of the radio base station inside a completed form of the antenna tower structure.

16. The method of claim 15 where the climbing facility and the elevator system permit the whole antenna radio base station, comprising at least one antenna and at least one micro wave link, to be rigidly connected both in operation and in service mode.

17. The method of claim 13 where the antenna tower structure sections comprise ends that fit together into forming a complete antenna tower structure having a conical shape.

18. The method of claim 17 where the antenna tower structure sections are put together by welding, screwing, riveting together, locking mechanism or wedging.

19. The method of claim 13 where the antenna tower structure sections, having each a hollowed cross section, are cast into any of the following shapes oval, square, rotating, triangular, rectangular, hexagonal, or octagonal.

20. The method of claim 13 where the antenna tower structure sections are to be constructed in such a way permitting on field manufacturing.

21. The method of claim 13 where an antenna tower structure top section is made in a form and of a material protecting the inside of the antenna tower structure, from rain and snow, and at a same time not significantly attenuating passage of radio signals.

22. The method of claim 13 where a Faradays cage is provided by including metal mesh and/or conductors in every section of the antenna tower structure and thereby achieving an integrated electricity conducting structure, which after assembly functions as a Lightning Protection Shield, LPS, for the whole antenna radio base station.

23. The method of claim 13 where a bottom section part of the antenna tower structure section is constructed in such form permitting directly earth attachment, with expandable piles and/or anchors, without requirement for additional construction work.

24. The method of claim 13 where lower and higher antenna tower structure sections comprise at least one controllable ventilation opening.

25. The method of claim 13 where at least one section of the antenna tower structure comprises support for an advertising board.

26. The method of claim 13 where the antenna tower structure sections after assembly form a conical antenna tower structure with a typical height between 15 to 45 meters.

27. A method of manufacturing a radio base station antenna tower structure for use in a wireless communications network, the method comprising:

casting a first tubular tower section having a hollowed cross section made of concrete;

casting a second top section having a hollowed conical shape with a closed upper part;

arranging the first tubular tower section with at least one entrance;

arranging the first tubular tower section for a mechanism for moving at least a whole antenna radio base station along an elongation of the first tubular tower section; and arranging the antenna tower structure sections for inclusion of a service access system, wherein the at least one entrance gives access to the whole antenna radio base station at any position of the antenna radio base station inside the antenna tower structure, by aid of the service access system including a moving arrangement, a climbing facility and/or an elevator system.

28. A wireless communications system comprising:

one or more antenna tower structures, each of the antenna tower structures being cast and divided into tubular tower sections having a hollowed cross section made of concrete, and having an arrangement for moving a whole antenna radio base station along the elongation of the respective antenna tower structure; and the whole antenna radio base station disposed inside at least one of the tubular tower sections, and where each antenna tower structure has at least one entrance into the antenna tower structure giving access for service of the antenna Radio Base station, wherein the at least one entrance gives access to the whole antenna radio base station at any position of the antenna radio base station inside the antenna tower structure, by aid of a moving arrangement, a climbing facility and/or an elevator system.

* * * * *

UNITED STATES PATENT AND TRADEMARK OFFICE

CERTIFICATE OF CORRECTION

PATENT NO. : 8,125,403 B2
APPLICATION NO. : 12/293689
DATED : February 28, 2012
INVENTOR(S) : Häger It is certified that error appears in the above-identified patent and that said Letters Patent is hereby corrected as shown below:

On the Title Page, Item (12), under "United States Patent", Line 1, delete "Hager" and insert -- Häger --, therefor.

On the Title Page, Item (75), under "Inventors", Line 1, delete "Peter Hager," and insert -- Peter Häger, --, therefor.

In the Drawings:

In Fig. 3, Sheet 2 of 6, delete "FIG 3" and insert -- FIG. 3 --, therefor.

In the Specifications:

In Column 1, Line 63, delete "publics view," and insert -- public's view, --, therefor.

In Column 2, Line 28, delete "electro magnetic pulses (EMPs)." and insert -- electromagnetic pulses (EMPs). --, therefor.

In Column 3, Line 3, delete "Block" and insert -- block --, therefor.

In Column 5, Line 42, delete "elevator system" and insert -- elevator system 11 --, therefor.

In Column 6, Line 23, delete "base section" and insert -- base section 6 --, therefor.

In Column 6, Line 35, delete "base section part 6" and insert -- base section 6 --, therefor.

In Column 7, Line 5, delete "further," and insert -- further --, therefor.

In the Claims:

In Column 9, Line 37, in Claim 12, delete "Antenna" and insert -- An antenna --, therefor.

Signed and Sealed this
Fourteenth Day of May, 2013

Teresa Stanek Rea
*Acting Director of the United States Patent and Trademark Office*